US008616402B2

(12) United States Patent
Andrews

(10) Patent No.: US 8,616,402 B2
(45) **Date of Patent: *Dec. 31, 2013**

(54) FREE-STANDING, STACKABLE CEREAL BOWL WITH ELEVATED TROUGH AND METHOD OF USE

(71) Applicant: Edward A. Andrews, Palm Desert, CA (US)

(72) Inventor: Edward A. Andrews, Palm Desert, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/705,020

(22) Filed: Dec. 4, 2012

(65) Prior Publication Data

US 2013/0091808 A1 Apr. 18, 2013

Related U.S. Application Data

(63) Continuation of application No. 12/800,586, filed on May 18, 2010, now Pat. No. 8,322,558.

(51) Int. Cl.
*B65D 1/24* (2006.01)

(52) U.S. Cl.
USPC ..... 220/501; 220/575

(58) Field of Classification Search
USPC ..... 220/501, 505, 574, 575
See application file for complete search history.

(56) References Cited

U.S. PATENT DOCUMENTS

| | | | | |
|---|---|---|---|---|
| 1,520,402 | A | 12/1924 | Clemens | |
| D117,898 | S | 12/1939 | Carawan | |
| 2,207,417 | A | 7/1940 | Smith | |
| 4,351,444 | A | 9/1982 | Majewski | |
| D283,096 | S | 3/1986 | Uhrik | |
| D298,898 | S | 12/1988 | Roshau | |
| 5,172,826 | A | 12/1992 | Celaya | |
| 5,676,275 | A | 10/1997 | Khattar | |
| D426,751 | S | 6/2000 | Obra | |
| D439,471 | S | 3/2001 | Gee | |
| D481,594 | S | 11/2003 | Roehrig | |
| D618,511 | S | 6/2010 | Lugacy | |
| 8,322,558 | B2 * | 12/2012 | Andrews | 220/575 |
| 2005/0000969 | A1 | 1/2005 | Sokola | |
| 2008/0290097 | A1 | 11/2008 | Fischell et al. | |
| 2009/0120941 | A1 | 5/2009 | Garaysa | |

FOREIGN PATENT DOCUMENTS

WO WO 99-48409 9/1999

OTHER PUBLICATIONS

International Search Report and Written Opinion in PCT application No. PCT/US2011/036854; Feb. 8, 2012.

* cited by examiner

*Primary Examiner* — Anthony Stashick
*Assistant Examiner* — Christopher McKinley
(74) *Attorney, Agent, or Firm* — Louis J. Hoffman; William E. Markov

(57) ABSTRACT

A bowl includes a main bowl portion and an ancillary portion or trough integral with the side of the bowl that is shaped to receive cereal or other food as a staging location before the food is maneuvered into the main bowl portion.

7 Claims, 6 Drawing Sheets

FREE-STANDING, STACKABLE CEREAL BOWL WITH ELEVATED TROUGH AND METHOD OF USE

CROSS-REFERENCE TO RELATED APPLICATIONS

This application is a continuation of application Ser. No. 12/800,586, filed May 18, 2010, now U.S. Pat. No. 8,322,558.

BACKGROUND OF THE INVENTION

1. Field of the Invention

This invention has to do with cereal serving bowls, such as bowls used for serving breakfast cereal and milk.

2. Description of the State of the Art

Bowls of various sizes are used in the serving of breakfast cereals. The bowls will normally hold a quantity of cereal and a suitable liquid such as, but not limited to, milk.

It is known to provide bowls that have shapes augmenting the standard bowl shape. For instance, consider the following patents: "Cereal Bowl or the Like," U.S. Des. 283,096; "Multi-Layered Cereal Bowl," U.S. Des. 298,898; "Dish," U.S. Pat. No. 1,520,402; "Cereal Bowl," U.S. Pat. No. 2,207,417; "Cereal Bowl," U.S. Des. 426,751 and "Milk and Cereal Bowl," U.S. Pat. No. 5,676,275, all of these patents are herein incorporated by reference.

Although some of the bowls shown in the above patents are directed to the serving of cereal, none of the bowls encompass the advantages of the bowl presented herein. The bowls shown in the above patents have complex shapes that may prevent stacking of the bowls. The shape of the bowls may make the bowls difficult to clean and may subject the bowls to instability or fragility.

For instance, several of the bowls (see Des. 283,096; Des. 426,751; and U.S. Pat. No. 1,520,402) have a significant barrier between a first portion of the device and the portion where dry cereal is staged. Such a wall impedes the easy transfer of dry cereal from the cereal staging area into the milk-containing portion of the bowl.

The Roshau Des. 298,898 patent shows a complex structure that appears to be an unstable twin bowl unit whose method of use is not disclosed in the design patent. Its elevated bowl portion is deep with high walls and a broad base or floor that is significantly larger than the smaller bowl portion to which it is attached. This design may not be a free standing bowl. The elevated bowl portion may be heavier than the lower bowl portion especially when the extension is filled with dry cereal. To overcome this the lower bowl portion has been weighted to offset the weight of the upper bowl portion.

In one of the bowls mentioned above (Smith, U.S. Pat. No. 2,207,417) a hopper is provided. This design is impractical as cereal in the lowest section of the hopper will be in contact with milk in the bowl. This staged, now unintentionally milk-wetted cereal will be difficult to extract from the hopper element of the bowl resulting in a hopper outlet clogged with soggy cereal. Smith, the inventor of the cereal bowl of U.S. Pat. No. 2,207,417; recognizes this as a problem and states that there will be little, if any, liquid entering the hopper portion. In general this may not be true as the level of milk in the hopper will be at the same level as the milk in the bowl. It is suggested in Smith that there be only a small depth of milk in the bowl, only to the bottom edge of the hopper, however, such a shallow depth of milk will allow for only enough milk for a small serving of cereal. There may not be enough milk in the bowl portion to accommodate the cereal in the bowl and still have enough milk to accommodate the rest of the cereal in the hopper, unless the amount of staged dry cereal is very small amount of cereal.

U.S. Pat. No. 5,676,275 is also a complex bowl as it has two detachable sections with one section provided with a perforated well that allows milk to enter the well. Dry cereal is then pushed into the well to expose the cereal to the milk in the well. This design is much more complex than the instant invention.

The applicant hereto provides a simpler and more elegant solution.

SUMMARY OF THE INVENTION

The present invention provides, among other things, a cereal bowl that has a trough on the main bowl portion of the cereal bowl. The trough is integral with the bowl portion of the cereal bowl. The trough section is designed to hold cereal in a staged placement before the dry cereal in the trough is exposed to milk, a suitable liquid, or a cereal wetting substance.

It is an object of the invention to provide a cereal bowl that will enhance the cereal eating experience.

It is another object of the invention to provide a trough on a bowl, the trough being sized to accommodate approximately half of the capacity of the bowl portion of the cereal bowl.

It is another object of the invention to allow the consumption of cereal in a cereal bowl while maintaining a quantity of cereal in a dry state in a trough integral with the main bowl portion of the cereal bowl.

It is also an object of the invention to keep a portion of a serving of cereal dry while a portion of the serving of cereal is submerged or floating in/on milk in a bowl.

It is also an object of the invention to provide a brand promotional graphic carried in, on, or integral with the bowl.

It is also an object of the invention to provide a cereal bowl that has a sloped interior floor and a flat exterior bottom.

It is also an object of the invention to provide a cereal bowl that has a sloped interior floor.

It is also an object of the invention to provide a cereal bowl having an interior surface that facilitates "spooning out" the last remaining cereal in the bowl after most of the cereal and milk have been removed from the bowl.

It is also an object of the invention to provide a cereal bowl that includes a cereal staging trough with the cereal bowl being stackable with one and more than one similar cereal bowls.

It is also an object of the invention to conserve the amount of milk used in a serving of cereal by allowing a first amount of cereal to be submerged in an ample supply of milk in the bowl portion of the cereal bowl, retrieving cereal from the bowl with a spoon leaving some of the milk in the bowl, and then "feeding" "staged" cereal into the milk containing section of the cereal bowl.

It is another object of the invention to provide a freestanding cereal bowl that resists tipping when the cereal bowl is resting on a flat surface.

The preferred embodiments of the invention presented here are described below in the drawings and detailed specification. Unless specifically noted, it is intended that the words and phrases in the specification and the claims be given the plain, ordinary and accustomed meaning to those of ordinary skill in the applicable arts. If any other special meaning is intended for any word or phrase, the specification will clearly state and define the special meaning. Likewise, if a noun, term or phrase is intended to be further characterized or specified, such will include adjectives, descriptive terms or other modifiers in accordance with the normal precepts of English grammar. Absent use of such adjectives, descriptive terms or modifiers, it is the intent the nouns, terms or phrases be given their plain and ordinary English meaning to those skilled in the applicable arts.

Further, the use of the words "function," "means" or "step" in the Specification is not intended to indicate a desire to invoke the special provisions of 35 U.S.C. 112, Paragraph 6, to define the invention. To the contrary, if the provisions of 35 U.S.C. 112, Paragraph 6 are sought to be invoked to define the inventions, the claims will specifically state the phrases "means for" or "step for," and will also clearly recite a function, without also reciting in such phrases any structure, material or act in support of the function. Thus, even when the claims recite a "means for" or "step for" performing a defined function, if the claims also recite any structure, material or acts in support of that means or step, or that perform the function, then the intention is not to invoke the provisions of 35 U.S.C. 112, Paragraph 6. Moreover, even if the provisions of 35 U.S.C. 112, Paragraph 6 are invoked to define the claimed inventions, it is intended that the inventions not be limited only to the specific structure, material or acts that are described in the preferred embodiments, but in addition, include any and all structures, materials or acts that perform the claimed function as described in alternative embodiments, or that are well known present or later-developed, equivalent structures, material or acts for performing the claimed function.

BRIEF DESCRIPTION OF THE FIGURES

A more complete understanding of the present invention may be derived by referring to the detailed description when considered in connection with the following illustrative figures. In the figures, like reference numbers refer to like elements or acts throughout the figures.

DETAILED DESCRIPTION OF THE INVENTION

In the following description, and for the purposes of explanation, numerous specific details are set forth in order to provide a thorough understanding of the various aspects of the invention. It will be understood, however, by those skilled in the relevant arts, that the present invention may be practiced without these specific details. In other instances, known structures and devices are shown or discussed more generally in order to avoid obscuring the invention. In many cases, a description of the operation is sufficient to enable one to implement the various forms of the invention. It should be noted that there are many different and alternative configurations of this invention. The full scope of the invention is not limited to the examples that are described below.

Figure 1:
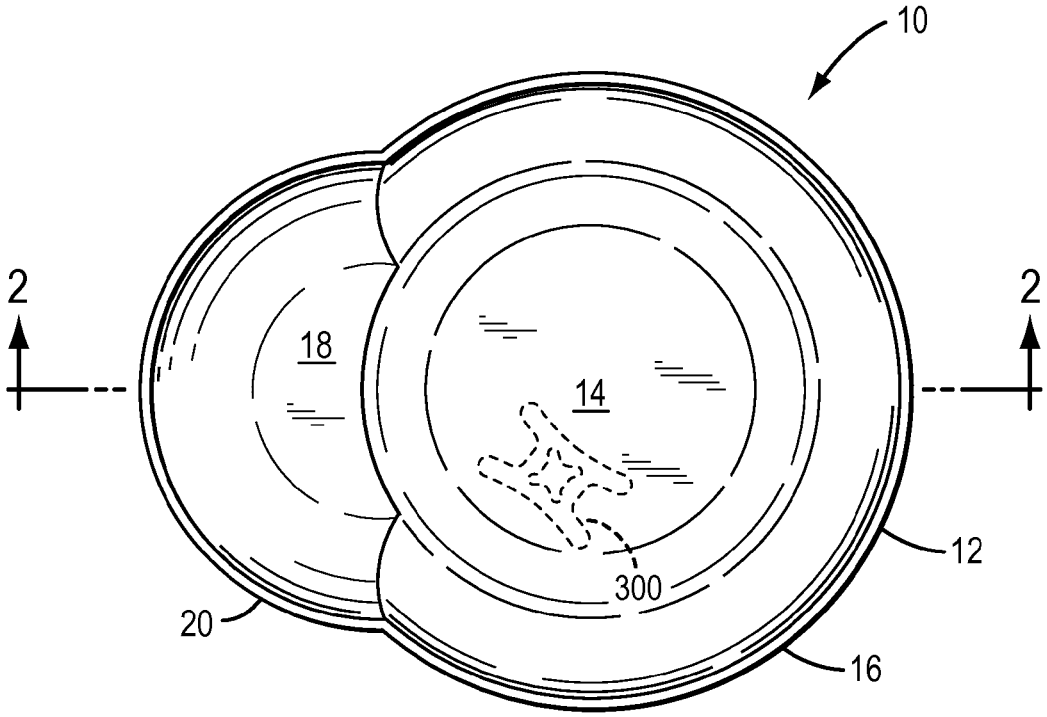
FIG. 1 is a top view of the cereal bowl disclosed herein.

In one embodiment of the invention shown in FIG. 1 there is a cereal bowl, generally 10, having a bowl portion 12. The bowl portion has a bottom 14 and an upwardly extending wall 16.

Integral with the bowl portion 12 at the top of the wall 16 is a trough portion 20. The trough portion 20 is a shallow trough arranged to follow the curve or a portion of the circumference of the main bowl portion. In one embodiment of the cereal bowl, the trough 20 extends about one-fourth of the bowl circumference along and around the upper edge of the wall 16. It, the trough portion 20 of the cereal bowl, generally 10, can extend further than or less then one fourth of the way around the circumference of the bowl.

In one embodiment of the bowl the trough has an upwardly extending wall element. In this embodiment the upwardly extending wall element of the main body portion of the bowl and the upwardly extending wall element of the trough portion flow together to be interconnected and extend upwardly to similar elevations.

The horizontal ledge of the trough would be somewhat elevated above the bottom of the bowl to allow for the supply of milk to remain separated from the contents on the trough of the bowl.

The bowls presented here are "free standing." That is each bowl is proportionately balanced, the bowl portion and the trough portions are proportionately balanced such that the bowls will not be unstable in use. The "free standing" bowls are intended to be stackable with bowls of similar shape.

The cereal bowl is designed to be a cereal bowl in which dry cereal is poured into the main bowl portion and into the trough portion of the bowl and an ample supply of milk or a suitable liquid is poured into the bowl portion 12 of the cereal bowl as is usually done.

In one embodiment of the bowl described here, the volume capacity of the trough portion of the bowl is generally about half of the volume of the bowl portion.

It is also contemplated that the cereal being put into the bowl and the cereal being put in the trough can be the same cereal, most usually a dry cereal product, or different foods, such as dry cereal and fruit or dry cereal and nuts.

Figure 2:
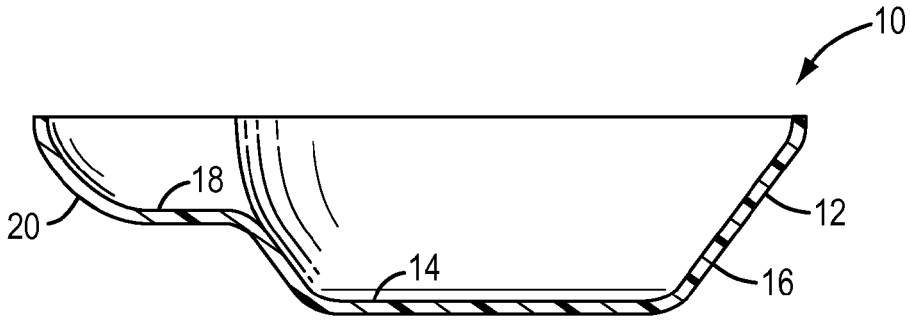
FIG. 2 is a cross sectional view through 2-2 of the cereal bowl shown in FIG. 1.

FIG. 2 is a side elevation view of the bowl of FIG. 1. In this figure the main bowl portion 12 is shown generally opposite the trough portion 20 of the bowl. The depth of the trough 20 from the top edge of the cereal bowl is seen at the right side of this figure. It can be seen in this figure, as well as in the other cross-sectioned views of bowls, that the trough portion 20, has a generally flat, unobstructed bottom surface 18 and an upwardly extending wall portion. This will assist and allow for the unobstructed flow of cereal when the cereal consumer pushes the dry cereal from the trough portion 20 into the main bowl portion 12 of the cereal bowl.

Figure 3:
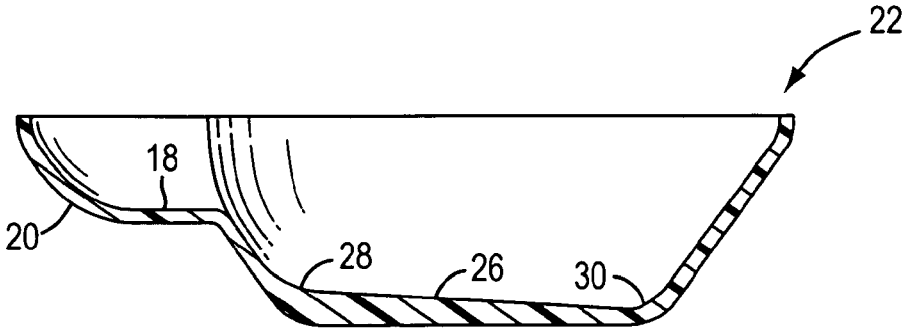
FIG. 3 is a cross sectional view of a bowl having a sloped inner bottom portion.

Another embodiment of the cereal bowl is shown in FIG. 3 as a sloped floor cereal bowl generally 22. In this embodiment, the floor 26 of the bowl is sloped to a lower point 30 so that milk or other suitable liquid will flow from portion 28 and gather in the lower point 30 of the cereal bowl. The thickness of the bottom of the main bowl portion would be slightly thinner at the lowest point 30 of the bottom of the bowl and thicker in other portions, such as area 28, of the bottom of the main portion of the cereal bowl.

In the embodiments shown above, it is noted that the cereal bowl shapes allow the stacking of the bowls for storage, shipping, and staging. Furthermore, in the embodiments set forth herein, the trough portion of the cereal bowl will be smaller than the bowl portion of the cereal bowl. The volume of the trough would hold approximately no more than fifty percent of the volume of the main portion of the cereal bowl.

In each of the embodiments shown it can be seen that there is a flat bottom on the exterior surface of the cereal bowl. This flat bottom allows the bowl to be free standing such that the cereal bowl will not tip either when it is full, partially full, or empty. This stability is also facilitated by having the size, mass and location of the trough portion of the cereal bowls proportionately balanced with the main portion of the cereal bowl. That is, the trough portion of the cereal bowl can be made to be either lighter, or at least no heavier, than the main bowl portion of the cereal bowl.

The versatile nature of this invention allows for a number of different embodiments shown in FIGS. 4-14. In various embodiments the bowl will have a main body portion and an attached trough. The main body will have a concave shape and an upwardly extending wall element and the trough will be integral with the upwardly extending wall. In another embodiment, the trough will be a horizontal ledge and will be attached to the upwardly extending wall at a point below the top of the wall. Yet another embodiment will have a trough that extends radially along the perimeter of the bowl. An alternative embodiment will be a bowl where the main portion has a round shape at the upper edge of the upwardly extending wall.

An additional embodiment will be a bowl where the main body portion has a bottom with an inner surface and an outer surface, and the two surfaces are generally parallel. A further embodiment will be a bowl having a bottom with an inner and outer surface, but the two surfaces will be non-parallel. An alternate version will be a bowl with a bottom portion composed of an inner and outer surface, and the outer surface will be generally horizontal.

Other embodiments the bowl would be rectangular, as shown in FIGS. 5-10, rather than generally round in a top view. Furthermore, other non-circular top view bowl shapes, such as is shown for example in FIGS. 13 and 14.

Further variations will be a bowl with a main body portion and attached trough where a graphic, such as the completely arbitrary example 300, which is only an example and not the only graphic that can be used as would be understood, is shown in a dotted line presentation in FIG. 1, is attached to the bowl. Other embodiments of this variation will have the graphic attached to the inner surface of the bottom of the bowl, the trough of the bowl, or the upwardly extending wall of the bowl. Another embodiment will have multiple graphics placed in two or more of the aforementioned locations. It is contemplated that the graphic can be a textual element, a trademark, a symbol, a picture, or the like, or any combination of graphics, text, and pictures. The bowl does not require the use of a graphic and any graphics may be left off the bowl.

Figure 4:
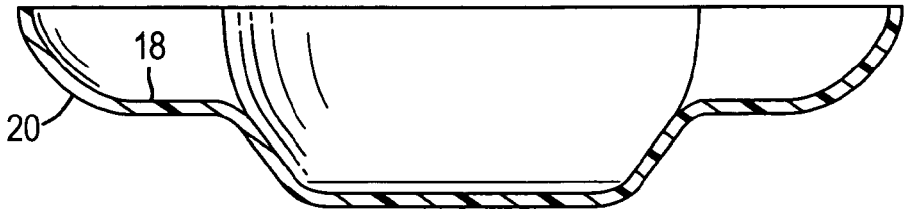
FIG. 4 is a cross sectional view of a version of a bowl.

FIG. 4 is similar to the bowl of FIG. 1 with the trough portion 20 extending more than one hundred and eighty degrees around the perimeter of the bowl.

Figure 5:
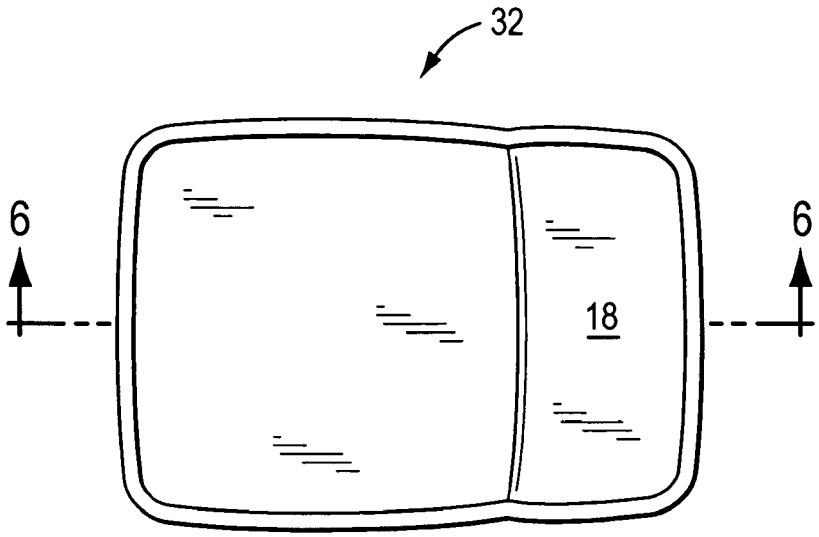
FIG. 5 is top view of a generally rectangular shaped bowl.
Figure 6:
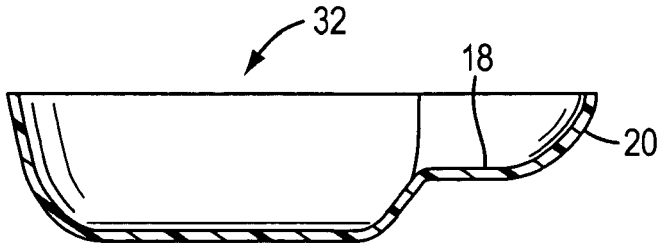
FIG. 6 is a cross sectional view through 6-6 of the bowl shown in FIG. 5.
Figure 7:
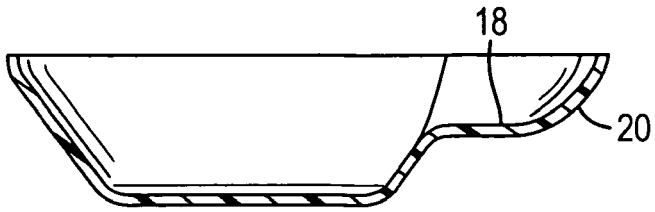
FIG. 7 is a cross sectional view of a rounded bowl similar to the bowl in FIG. 6.

FIGS. 5, 6 and 7 show a generally rectangular bowl 32 having a flat surface 18 of the portion of the trough 20 similar to the bowl shown in FIG. 1. The FIG. 7 version of this bowl has larger radius transitions between the floor of the bowl, the sidewalls and the other area of the trough portion as compared to FIG. 6.

Figure 8:
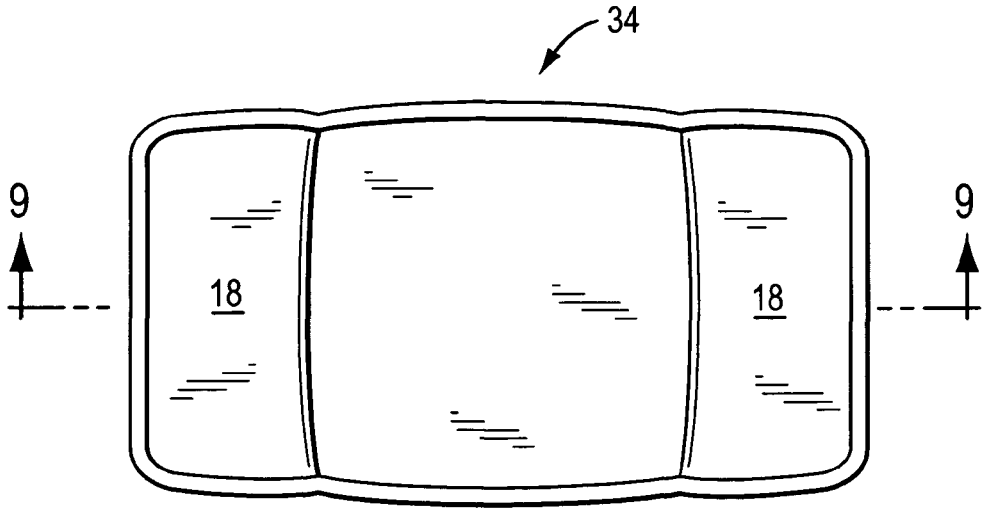
FIG. 8 is top view of a generally rectangular shaped bowl having two platforms.
Figure 9:
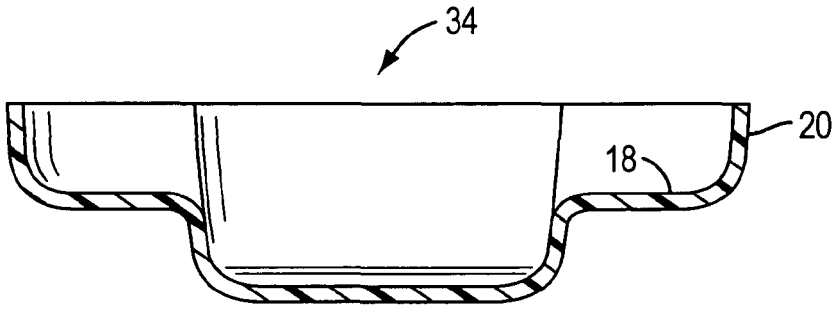
FIG. 9 is a cross sectional view through plane 9-9 of FIG. 8.
Figure 10:
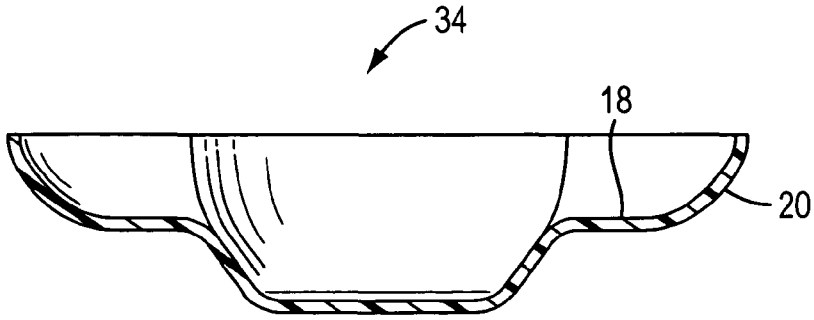
FIG. 10 is an alternative view of a smoothly contoured bowl similar to the bowl of FIG. 8.

FIGS. 8, 9 and 10 show another embodiment of a generally rectangular bowl 34 having a flat surface 18 of the portion of the trough 20 similar to the bowl shown in FIG. 5. In this embodiment there are platforms 18 on two of the sides of the generally rectangular shape of the bowl section as can be seen in these figures. The FIG. 10 version of this bowl has larger radius transitions between the floor of the bowl, the sidewalls and the other area of the trough portion as compared to FIG. 9.

Figure 11:
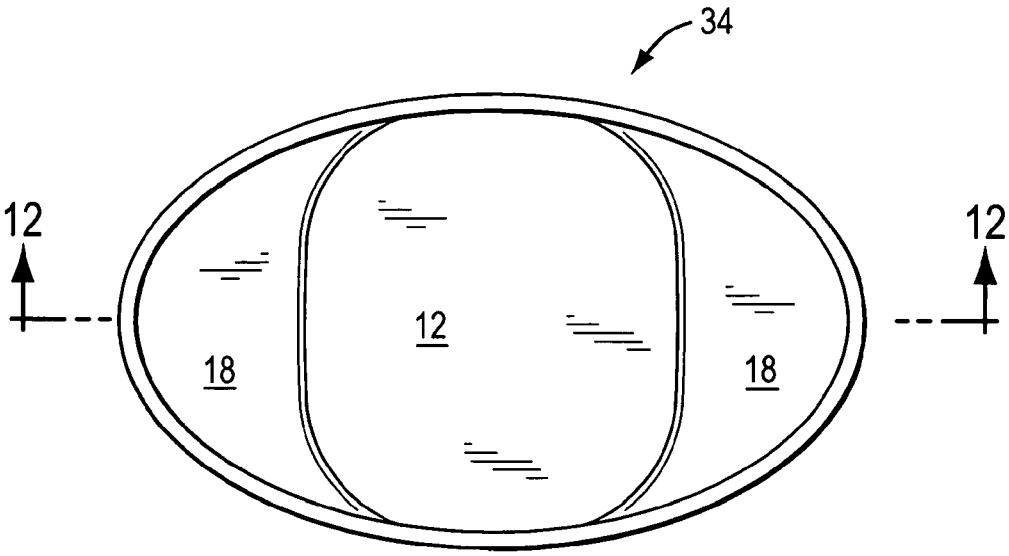
FIG. 11 is a top view of an alternative version of a cereal bowl.
Figure 12:
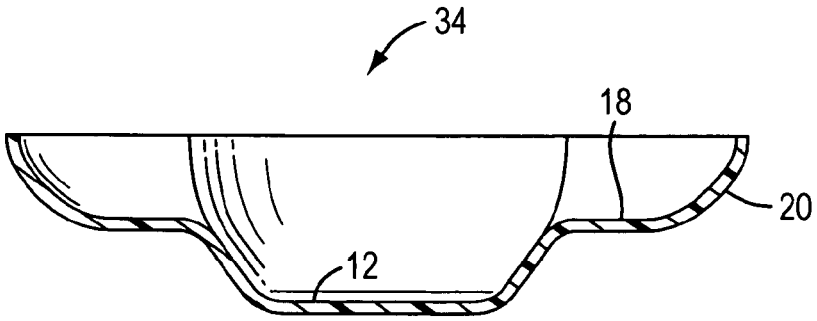
FIG. 12 is a cross-sectional view of the bowl in FIG. 11 through plane 12-12 of FIG. 11.

FIGS. 11 and 12 show another version of the bowl. In this version the center bowl section 12 is somewhat rectangular and there are platforms 18 on two of the sides of the bowl as shown in FIGS. 11 and 12. These platforms 18 may have a semicircular profile when viewed in the top view FIG. 11.

Figure 13:
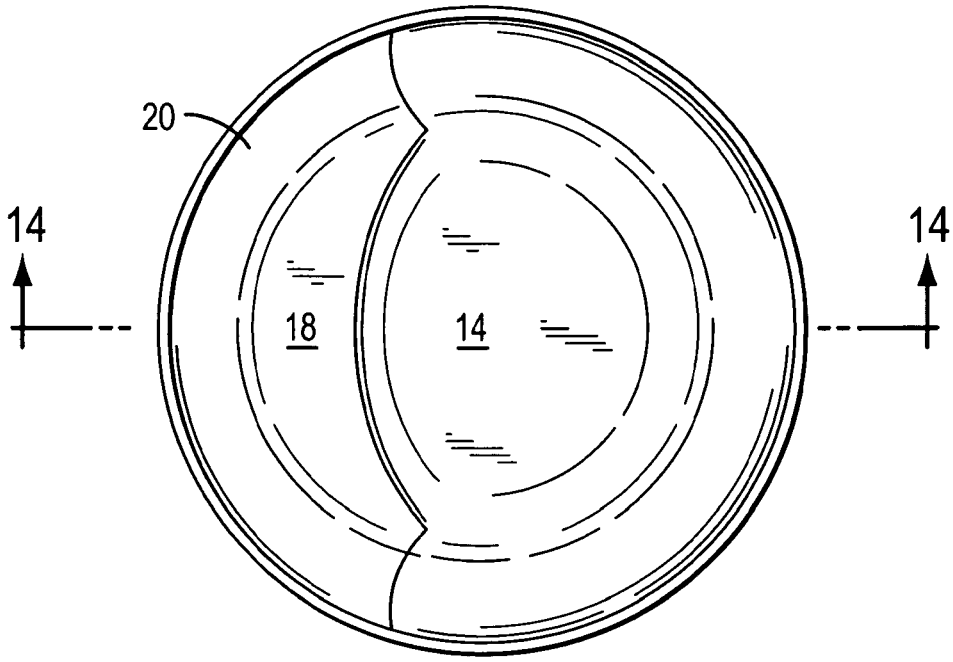
FIG. 13 is a top view of an alternative bowl incorporating the invention.
Figure 14:
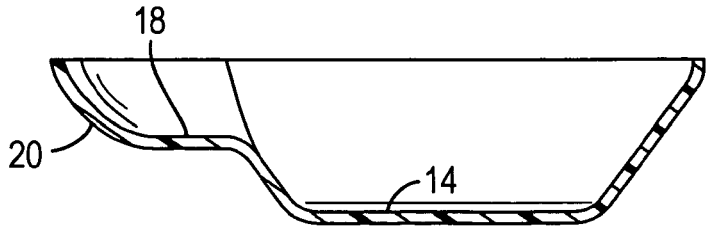
FIG. 14 is a cross-sectioned view through plane 14-14 of the bowl in FIG. 13

FIGS. 13 and 14 is generally similar to the FIG. 1 embodiment with the difference being that the elevated trough is located entirely within the circumference of the bowl, or entirely inside the perimeter in the case of a bowl that is generally rectangular.

Several different shapes bowls are presented above. Round, square and rectangular shapes are the primary shapes but it is also possible to have other bowl shapes, such as, but not limited to triangular, octagonal or multiple-sided shapes comprising the perimeter shape of the bowl.

Due to the innovative structure of this invention, new methods of cereal preparation and consumption will be possible. One such method will allow a fresh crispy supply of dry cereal to be available without being mixed with the cereal being consumed. Beginning with a serving bowl having a bowl portion, the first method requires integrating a trough on an upwardly extending wall of the cereal serving bowl, placing a serving of cereal in the cereal serving bowl, and placing a second serving of cereal in the trough on the side of the cereal serving bowl. This method may be further refined by adding the additional step of moving dry, crispy cereal from the trough portion of the bowl to the main portion of the bowl when the cereal initially placed in the cereal-serving portion of the bowl has been consumed.

In summary the invention comprises a bowl having, but not limited too, a main body portion with a concave shape and an upwardly extending wall element and a trough integral with the upwardly extending wall portion of the bowl. This trough comprises a generally horizontal ledge having a first margin in communication with the upwardly extending wall element at a point below the top of the upwardly extending wall element and may extend radially outwardly along the perimeter of the bowl, or, in another embodiment, it extends radially inwardly along the perimeter of the bowl.

The main portion of the bowl can be of any general shape, such as, but not limited to a generally round, obround or curved shape at the upper edge of the upwardly extending wall element, a generally rectangular or square shape at the upper edge of the upwardly extending wall element, or, but not limited to, a multisided shape at the upper edge of the upwardly extending wall element.

The main body portion of the bowl comprises a bottom with an inner surface and an outer surface, the inner surface and the outer surface each being generally parallel to the other in one embodiment or generally non-parallel to the other in another embodiment. In either embodiment the bowl is proportionately balanced relative to the mass of the trough portion of the bowl. It has been found that when the capacity in volume of the tough portion of the bowl is approximately half the capacity in volume of the main body portion of the bowl the proportions of the bowl are about right for fulfilling its use. It has also been found that it is advantageous, and an object of this invention to have the bowls stackable with bowls having the same general shape.

Or stated another way, the invention herein is a bowl comprising a main body portion having a perimeter and a concave shape with an upwardly extending wall element. The bowl includes a trough integral with the upwardly extending wall portion of the bowl. This trough has a generally horizontal ledge with a first margin in communication with the upwardly extending wall element at a point below the top of the upwardly extending wall element. The trough element of the bowl may extend radially outwardly along the perimeter of the bowl, or, in another embodiment the trough may extend radially inwardly along the perimeter of the bowl. In either case the trough can be a generally flat unobstructed surface.

To use the bowl of the invention, where one of the objects is to ensure a supply of dry cereal is not initially mixed with a supply of dry cereal and ample supply of milk in a bowl. To accomplish this a partial serving of dry cereal and an ample supply of milk ARE is placed in the bowl portion of the serving bowl. A second partial serving of dry cereal is placed in the trough portion on the side of the bowl. The second serving of dry cereal is moved from the trough into the bowl portion of the bowl when a portion of the serving of dry cereal initially placed in the bowl portion of the bowl has been consumed from the bowl portion.

While the invention is described herein in terms of preferred embodiments and generally associated methods, the inventor contemplates that alterations and permutations of the preferred embodiments and methods will become apparent to those skilled in the art upon a reading of the specification and a study of the drawings.

Accordingly, neither the above description of preferred exemplary embodiments nor the abstract defines or constrains the invention. Rather, the claims variously define the invention. Each variation of the invention is limited only by the recited limitations of its respective claim, and equivalents thereof, without limitation by other terms not present in the claim.

What is claimed is:

1. A method of ensuring that a supply of dry cereal is not initially mixed with a supply of wetted cereal in a bowl, the bowl having:

(i) an interior surface comprising:

(1) an interior bottom surface;

(2) an elevated surface adjacent to the bottom surface;

(3) a first wall portion that extends upward from the interior bottom surface toward a first portion of a rim;

(4) a second wall portion that extends upward from the interior bottom surface to the elevated surface; and (5) a third wall portion that extends upward from the elevated surface toward a second portion of the rim;

(6) wherein the first portion of the rim and the second portion of the rim extend upward to at least similar elevations; and (ii) an exterior surface having an exterior bottom surface and a shape that substantially corresponds to the interior surface, whereby the bowl is stackable, with another bowl having the same shape, (1) with the exterior surface of the bowl substantially adjacent to an interior surface of the other bowl when the bowl is stacked above the other bowl, and (2) with the interior surface of the bowl substantially adjacent to an exterior surface of the other bowl when the bowl is stacked below the other bowl;

(iii) wherein the interior surface and a horizontal plane containing the lowest portion of the rim together enclose a volume containing (1) a main cavity circumscribed by the first wall portion and the second wall portion and (2) a trough circumscribed by the second wall portion and the third wall portion, which features (iii)(1) and (iii)(2) are coextensive and connected without substantial obstruction therebetween; and (iv) wherein the main cavity and the trough are configured and sized relative to each other so that the bowl remains stable when the bowl is sitting on the exterior bottom surface both (1) when the bowl is empty and (2) when the bowl is filled, to any level between the elevated surface and the plane, with a food product comprising a dry cereal, the method comprising:

placing a first quantity of dry cereal in the main cavity of the bowl;

(b) placing a second quantity of dry cereal in the trough of the bowl.

2. The method of claim 1 further comprising moving at least a portion of the second quantity of dry cereal from the trough to the main cavity of the bowl when at least a portion of the first quantity of dry cereal in the main cavity of the bowl has been consumed.

3. The method of claim 1 further comprising:

(A) placing a quantity of milk in the main cavity but not in the trough so that the first quantity of dry cereal is wetted; and (B) moving at least a portion of the second quantity of dry cereal from the trough to the main cavity after at least a portion of the first quantity of wetted cereal in the main cavity has been consumed but when at least some of the milk remains in the main cavity;

whereby the moved portion of the second quantity of dry cereal is wetted by the remaining milk and the main cavity is resupplied with wetted cereal.

4. An apparatus for holding food comprising a bowl having:

(a) an interior surface comprising:

(i) an interior bottom surface;

(ii) an elevated surface adjacent to the bottom surface;

(iii) a first wall portion that extends upward from the interior bottom surface toward a first portion of a rim;

(iv) a second wall portion that extends upward from the interior bottom surface to the elevated surface; and (v) a third wall portion that extends upward from the elevated surface toward a second portion of the rim;

(vi) wherein the first portion of the rim and the second portion of the rim extend upward to at least similar elevations; and (b) an exterior surface having an exterior bottom surface and a shape that substantially corresponds to the interior surface, whereby the bowl is stackable, with another bowl having the same shape, (i) with the exterior surface of the bowl substantially adjacent to an interior surface of the other bowl when the bowl is stacked above the other bowl, and (ii) with the interior surface of the bowl substantially adjacent to an exterior surface of the other bowl when the bowl is stacked below the other bowl;

(c) wherein the interior surface and a horizontal plane containing the lowest portion of the rim together enclose a volume containing (i) a main cavity circumscribed by the first wall portion and the second wall portion and (ii) a trough circumscribed by the second wall portion and the third wall portion, which elements (c)(i) and (c)(ii) are coextensive and connected without substantial obstruction therebetween; and (d) wherein the main cavity and the trough are configured and sized relative to each other so that the bowl remains stable when the bowl is sitting on the exterior bottom surface both (i) when the bowl is empty and (ii) when the bowl is filled, to any level between the elevated surface and the plane, with a food product comprising a dry cereal.

5. The apparatus of claim 4 wherein the trough has a volume that is approximately half of the volume of the main cavity.

6. The apparatus of claim 4 wherein the interior bottom surface of the bowl and the exterior bottom surface of the bowl are separated by a distance that is greater at a first location that is near the second wall portion than at a second location that is more distant from the second wall portion.

7. The apparatus of claim 4 wherein the second wall portion is about one third of the length of the first wall portion.

* * * * *

UNITED STATES PATENT AND TRADEMARK OFFICE

CERTIFICATE OF CORRECTION

PATENT NO. : 8,616,402 B2
APPLICATION NO. : 13/705020
DATED : December 31, 2013
INVENTOR(S) : Edward A. Andrews It is certified that error appears in the above-identified patent and that said Letters Patent is hereby corrected as shown below:

In the Claims:

In Column 8, line 15 (Claim 1): insert --(a)-- before "placing"

Signed and Sealed this
Eighteenth Day of March, 2014

Michelle K. Lee

Michelle K. Lee
*Deputy Director of the United States Patent and Trademark Office*